United States Patent [19]

Steinbicker et al.

[11] Patent Number: 4,840,712

[45] Date of Patent: Jun. 20, 1989

[54] PROCESS FOR IMPROVING WEAR ON CONDUCTOR ROLLS IN ELECTROPLATING OF STEEL SURFACES

[75] Inventors: Richard N. Steinbicker, Allentown; Herbert E. Townsend, Center Valley; Yung-Herng Yau, Allentown, all of Pa.

[73] Assignee: Bethlehem Steel Corporation, Bethlehem, Pa.

[21] Appl. No.: 256,977

[22] Filed: Oct. 13, 1988

[51] Int. Cl.[4] ..... C25D 5/04

[52] U.S. Cl. ..... 204/28

[58] Field of Search ..... 204/28, 206, 207, 208, 204/209, 210, 211

[56] References Cited

U.S. PATENT DOCUMENTS

| | | | |
|---|---|---|---|
| 4,282,073 | 8/1981 | Hirt et al. | 204/28 |
| 4,416,737 | 11/1983 | Austin et al. | 204/28 |
| 4,608,091 | 8/1986 | Sullivan et al. | 134/3 |

*Primary Examiner*—G. L. Kaplan

*Attorney, Agent, or Firm*—Steele, Gould & Fried

[57] ABSTRACT

The invention relates to an improvement in a process for electrodepositing a protective coating of zinc or a zinc alloy on steel or other metal substrates in which the process utilizes a metal conductor roll or conductor roll with metal sleeves and contains a rinsing bath with a mineral acid solution associated with the roll, the improvement comprises providing at least 50 ppm of hydrogen peroxide or a peroxydisulfate compound in the mineral acid bath.

19 Claims, 7 Drawing Sheets

PROCESS FOR IMPROVING WEAR ON CONDUCTOR ROLLS IN ELECTROPLATING OF STEEL SURFACES

FIELD OF THE INVENTION

This invention relates to a method for reducing electrochemical corrosion and mechanical wear of iron or steel conductor rolls in an electroplating process. More particularly, the invention is related to a reduction of wear of stainless steel or other metal alloy conductor rolls or conductor roll sleeves in an electroplating process of placing zinc and zinc alloys onto a steel surface with the use of a hydrogen peroxide or peroxydisulfate compound conductor roll rinse solution.

BACKGROUND OF THE INVENTION

The tendencies of iron or steel surfaces to corrode is well known. Zinc is one of the most widely used metallic coatings applied to steel surfaces to protect them from corrosion. Zinc has been electroplated on steel surfaces from various plating baths, preferably from acid plating baths, for providing protection of steel surfaces for various uses.

It is known from U.S. Pat. No. 2,419,231 to Shanz to improve corrosion resistance of the coating by using for the coating an alloy high in zinc and low in nickel. The alloy is co-deposited from the electrotic plating bath onto the steel substrate.

U.S. Pat. No. 4,282,073 to Hirt et al, which is herein incorporated by reference, discloses a process for electroplating steel surfaces in which the present invention can provide an improvement.

U.S. Pat. No. 4,608,091 discloses the use of hydrogen peroxide for use in compositions useful for the selective stripping of protective hard surfaces, coatings and nickel-based brazes from metals. For stripping steel, a composition containing hydrogen peroxide and phosphorous-oxy acid is preferred.

U.S. Pat. No. 4,416,737 to Rustin et al, which is herein incorporated by reference, discloses a process for the electrodeposition of a nickel-zinc alloy on a stell substrate from a nickel salt-boric acid electrolyte containing at least about 40 ppm zinc at temperatures ranging from about 120° to 160° F. The process includes the step of adding hydrogen peroxide to the plating solution to oxidize the iron contaminate and to precipitate it, and then remove the precipitate from the solution. An amount of 0.5 ml of hydrogen peroxide to a liter of Watts nickel bath containing 117 mg/1 iron was proposed.

It has been discovered that in a process for electroplating a steel surface utilizing a zinc sulfate electroplating solution and dilute sulfuric acid rinsing water, the electrochemical corrosion of the stainless steel conductor rolls accounts for approximately 16% of the actual diameter loss of the rolls. This suggests a synergistic effect between electrochemical corrosion and mechanical wear. Applicants hvae found that the corrosion rate increases as the temperature increases (from 55° to 75° C.).

Considering the corrosion aspect, the mechanisms were found to be a cyclic change between electrochemically active and passive states. That is, if there are zinc deposits on the surface of the conductor rolls while they are immersed in the rinsing water, the zinc deposits activate the conductor roll surface and destroy its passive state. As soon as the zinc dissolves completely or the conductor roll emerges from the rinsing solution, the conductor roll surface wants to become passive, resulting in a high corrosion rate during this passive film formation. The frequent removal, regrinding and eventual replacement of conductor rolls or roll sleeves casued by the high corrosion rate results in high maintenance costs and frequent shut downs of the electroplating process.

SUMMARY OF THE INVENTION

The present invention relates to a means for improving the wear-life of steel, stainless steel or other metal alloy conductor rolls or conductor roll sleeves in a process for electroplating a protective coating of zinc or zinc alloy onto an iron or steel substrate in which said process includes a conductor roll rinsing step with a mineral acid. More particularly, this invention provides a rinse solution of a dilute sulfuric acid solution with at least 50 ppm, preferably 500 to 1000 ppm of hydrogen peroxide or the equivalent concentration of peroxydisulfate compounds. It is believed that hydrogen peroxide and the peroxydisulfate compounds do not improve the corrosion resistance of the conductor roll by preventing it from being activated by deposited zinc, but they reduce the corrosion rate by accelerating the process of passive film formation during each active-passive transition cycle. The peroxydisulfate is an alkali or alkaline earth metal or ammonium salt, preferably ammonium, potassium or sodium peroxydisulfates.

It has been found to be advantageous to maintain the rinse solution at a temperature of less than 50° C., preferably about 45° C.

Also, it has been found that the corrosion rate of the conductor rolls increases as the pH of the rinse solution decreases from 2 to 1.

In another embodiment of the invention there is provided a method for preventing corrosion during depassivation-repassivation stages of a conductor roll or conductor roll sleeve which is partially immersed in a mineral acid rinsing solution during a process for electrodepositing a protective coating of zinc or a zinc alloy onto a steel substrate. The method comprises the steps of providing the rinsing solution with an oxidizing agent for causing the repassivation time to be less than the time of immersion in the rinsing solution. Preferably, the oxidizing agent is selected from the group consisting of sodium peroxydisulfate, potassium peroxydisulfate, ammonium peroxydisulfate and hydrogen peroxide.

It is therefore an object of the invention to provide a means for improving the wear life of conductor rolls in a process for electroplating zinc or zinc alloys on steel substrates.

It is another object of this invention to accelerate the redissolution of zinc from the conductor roll surfaces by the utilization of hydrogen peroxide or peroxydisulfate compounds.

It is a further object to reduce the corrosion rate of the conductor rolls by accelerating the process of passive film formation during each active-passive transition cycle.

These and other objects are achieved by the present invention which will be more fully and completely described herein in conjunction with both the general description, the appended examples and the drawings.

BRIEF DESCRIPTION OF THE DRAWING(S)

DESCRIPTION OF THE PREFEREED EMBODIMENT(S)

Figure 1:
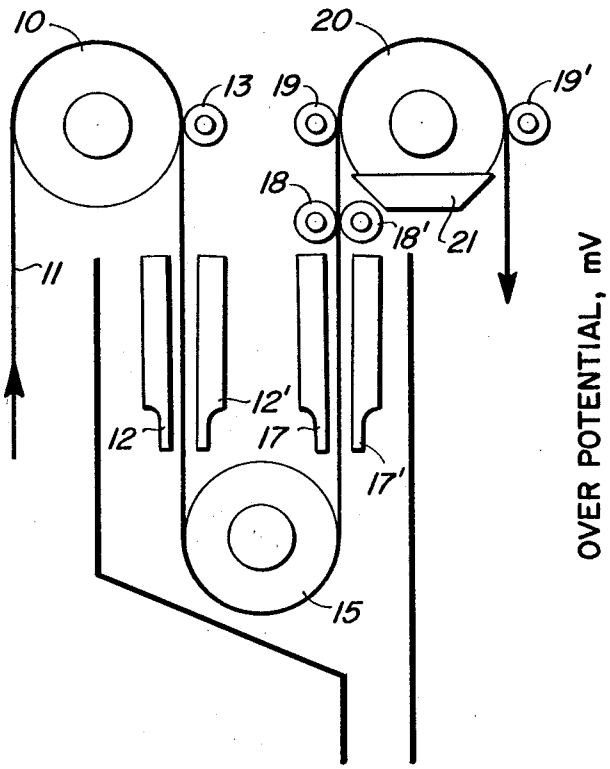
FIG. 1 is a schematic diagram of a plating operation which incorporates the process of this invention.

As shown in FIG. 1, in a typical plating operation, the steel strip 11 passes between a conductor roll 10 and hold down roll 13 and then through anodes 12, 12′. The strip 11 then proceeds around a rubber covered sink roll 15 to the next plating anodes 17, 17′. The strip 11 from the plating anodes 17, 17′ passed through squeegee rolls 18, 18′ over conductor roll 20 and between the hold-down rolls 19, 19′. An electrical current associated with depositing zinc from the plating bath flows from the steel strip 11 to the conductor roll 20 and generates heat which is removed by cooling water inside the conductor roll 20. Some plating solution is carried by the steel strip 11 through the squeegee rolls 18, 18′ to the conductor roll 20. The zinc ions in the plating solution tend to deposit on the conductor roll 20, resulting in dents on the surface of the passing electrogalvinized strip 11.

To dissolve these zinc deposits, the conductor roll 20 partially immersed in the dilute sulfuric acid solution in a rinse pan 21. Therefore, the conductor roll is cyclically subject to two corrosive environments—the plating solution and the rinsing solution. According to the present invention, it has been found that providing the rinsing solution with at least 50 ppm hydrogen peroxide substantially reduces the corrosion of the roll in the rinsing solution and the accumulation of zinc deposits.

EXAMPLE 1

To understand the corrosion mechanism involved in this operation, the polarization behaviors of stainless steel conductor roll sleeves in plating solution and rinsing water environments have been studied. The polarization curves are determined potentiodynamically by using an EG&G Corrosion Measurement Console. The corrosion current densitites are estimated by cathodic Tafel extrapolation. The active-passive transition is studied by anodic polarization. Although the polarization curves measured at 1 mV/sec are not at steady states, they do represent the trend as the corrosion environment changed. The corrosion of conductor rolls never reaches a steady state in operation as the corrosion environment changed from rinsing water to plating solution every few seconds. (The rotation speed of a typical conductor roll is 19.1 rpm at a line speed of 200 ft/min.). The experiments are conducted in actual plating solution and synthetic rinsing solution, i.e., distilled water and sulfuric acid.

(A) Plating Solution

Figure 2:
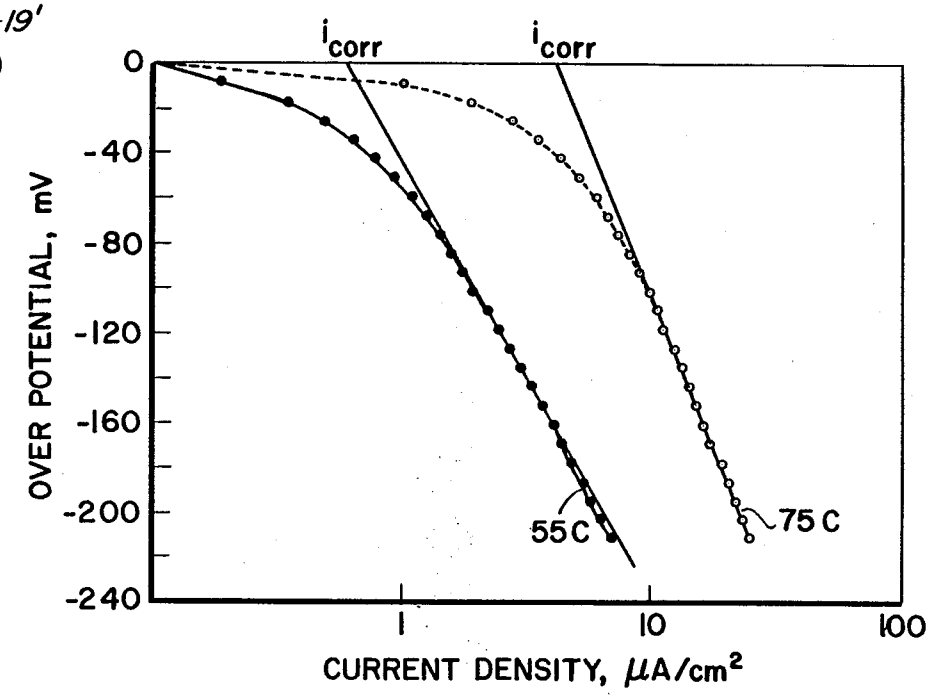
FIG. 2 shows the cathodic polarization curves of stainless steel in plating solution.

The cathodic polarization curves of stainless steel conductor roll sleeves in plating solution are shown in FIG. 2. As the temperature is raised from 55° to 75° C., the curve shifts toward higher current densities and the Tafel slope ($\beta_c$) increases from 220 to 305 mV/decade. The corrosion current density, determined by Tafel extrapolation, increases from 0.7 to 5.2 $\mu$/cm$^2$, Table 1. The corrosion potentials stay constant at about +336 mV, which is in the passive rnage of the stainless steel sleeves. Thus, it is important to maintain proper cooling of the conductor roll. During electroplating, an external current is passing through the conductor roll and polarizes it to a less noble potential. However, the corrosion rate increases with rising temperature.

(B) Rinsing Solution

Figure 3:
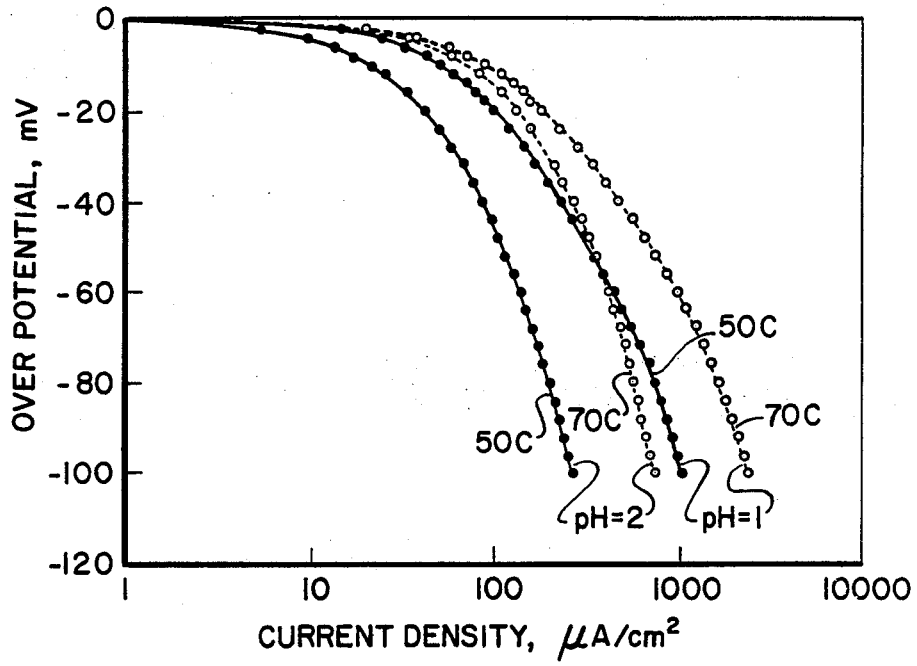
FIG. 3 shows the effects of temperature and pH of the rinsing solution on cathodic polarization curves.

FIG. 3 shows the effects of temperature and pH of the rinsing solution on cathodic polarization curves for stainless steel conductor roll material. Higher temperature and lower pH increase the cathodic current densities, resulting in an increase of corrosioin currnet densities. As shown in Table 2, the corrosion current density increases by more than 100% as the temperature is raised from 50° to 70° C. Lowering the pH from 2 to 1 only causes a 30% increase. Thus, it is important to maintain the temperature of the rinsing solution at the lowest possible level.

Figure 4:
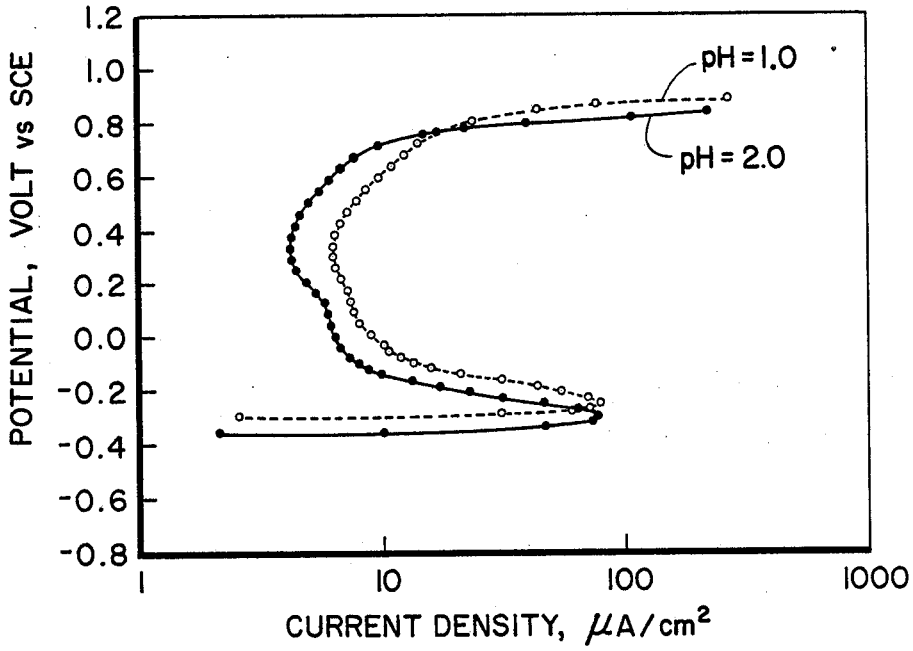
FIG. 4 shows the anodic polarization curves in a typical active-passive behavior of stainless steel in sulfuric acid.

FIG. 4 shows the anodic polzriation curves in a typical active-passive behavior of stainless steel in sulfuric acids. Lowering the pH from 2 to 1 slightly moves the corrosion potential in the noble direction by about 60 mV and increases the current densitites in the passive range.

Figure 5:
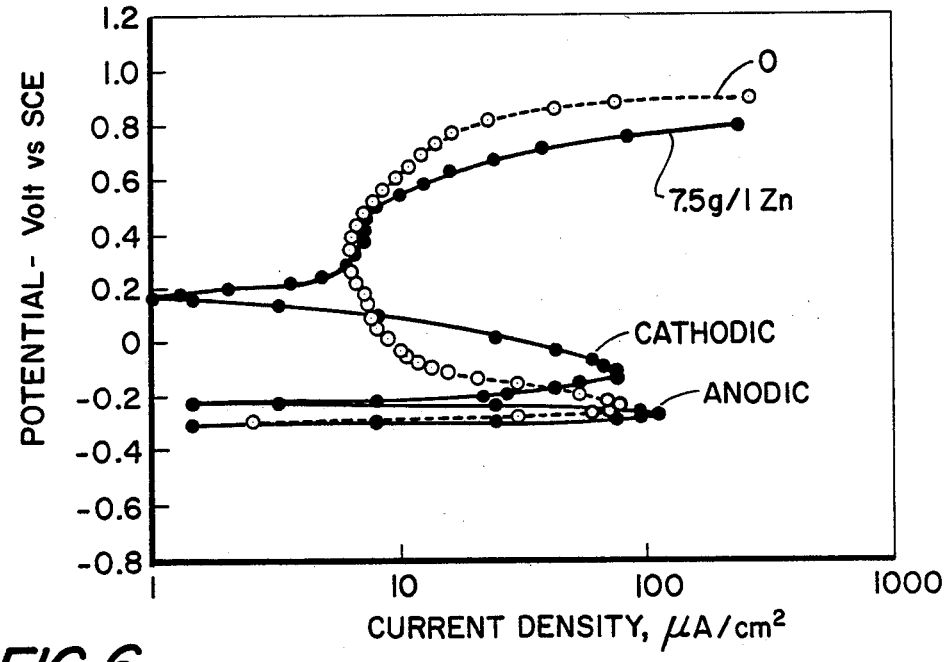
FIG. 5 shows the polarization curve of stainless steel in rinse solution containing plating solution.
Figure 6:
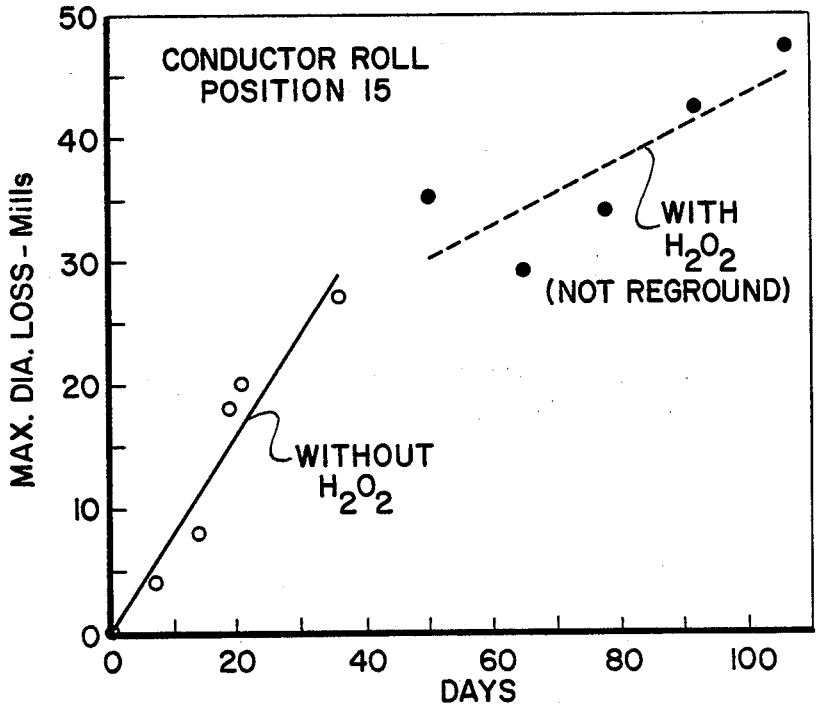
FIGS. 6–10 show linear regression plots of loss of diameters of conductor rolls with and without hydrogen peroxide addition to rinse solution.
Figure 7:
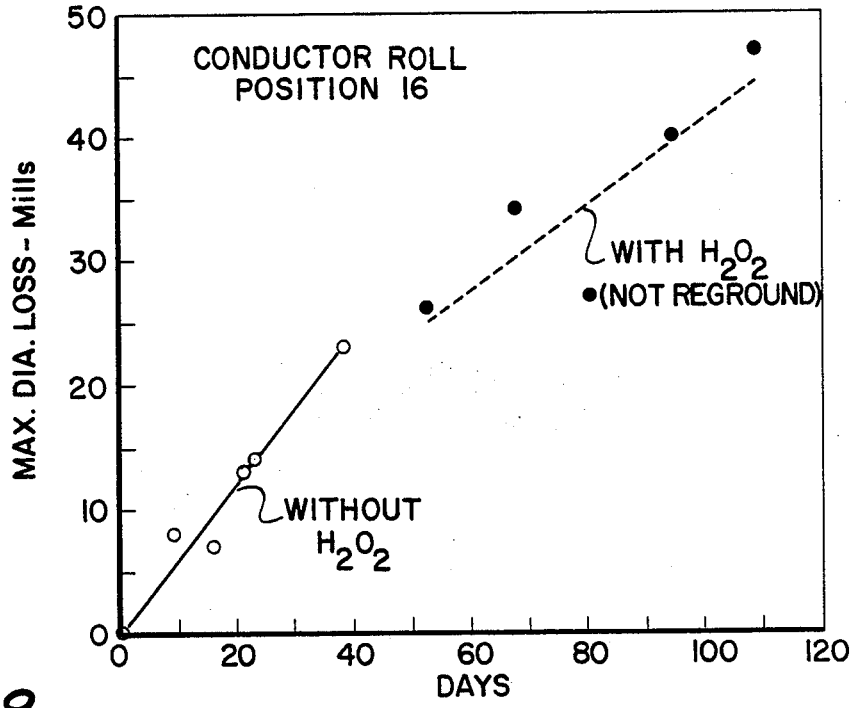
Figure 8:
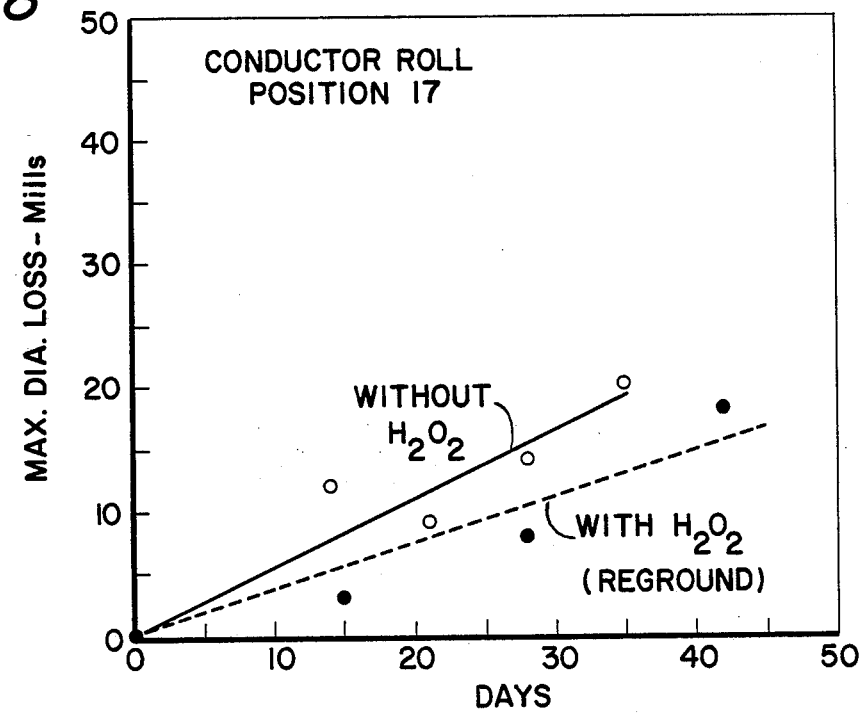
Figure 9:
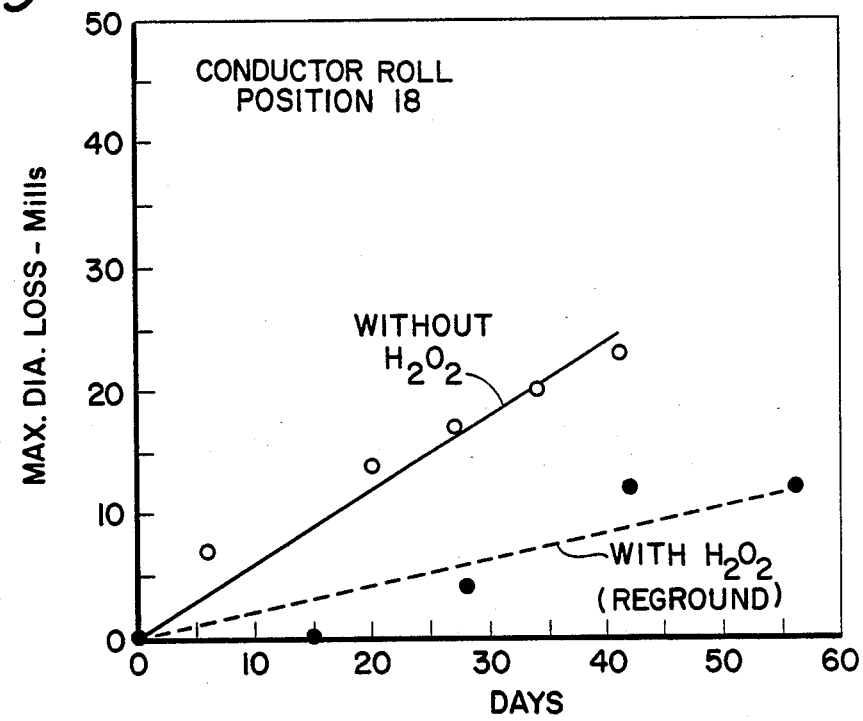
Figure 10:
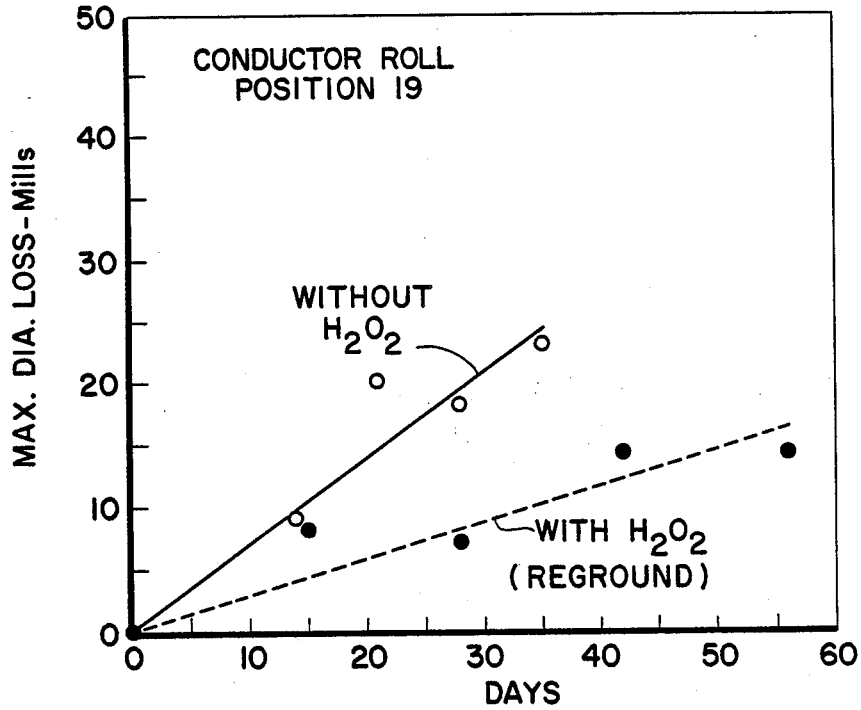

In actual operation, the rinsing solution is contaminated by the plating solution, and the zinc ion concentration is preferably controlled below 8 g/l . To simulate this condition, a synthetic solution with 7.5 g/l zinc ion was made by adding actual plating solution to pure sulfuric acid solution. The addition of plating solution increased the corrosion rate in the active range but caused a second "cathodic" loop between −200 and +150 mV with respect to a saturated calomel electrode, as shown in FIG. 5. Thus, stainless steel sleeves can be either active or passive in this environment.

The corrosion mechanism of the conductor roll, therefore, appears to be a constant change between electrochemically active and passive states. The deposit of zinc on the conductor roll drives the corrosion potential of the stainless steel sleeves in rinsing water close to −980 mV, the corrosion potential of zinc. The stainless steel is galvanically protected by zinc. However, once zinc is completely dissolved, stainless steel sleeves tend to passivate, resulting in a high corrosion rate during the passive film formation. The passive state is destroyed immediately after the zinc is again deposited.

The diameter loss of conductor rolls has been measured to be 2.4 x $10^{-5}$ inch/hour which is equal to 228 $\mu$A/cm$^2$. The corrosion current densities estimated in the most corrosive conditions, i.e., 70° C. and pH 1 of rinsing water and 75° C. of plating solution, are 100 and 5.2 $\mu A/cm^2$, respectively. Assuming the conductor roll is in contact with the rinsing water one-third of the service time and two-thirds with the plating solution, the total corrosion rate is about 37 $\mu A/cm^2$, or 16% of the actual diameter loss. Thereafter, the actual diameter loss might be a result of the combination of electromchemical corrosion, erosion corrosion and mechanical wear.

Alternatively, the oxide film formed during repassivation may help protect against wear as well as corrosion.

In the rinsing solution, the corrosion rate of the stainless steel sleeves increases as the temperature increases (from 50° to 70° C.) or the pH decreases (from 2 to 1).

The corrosion mechanism is a result of constant changes between active and passive states.

TABLE I

RESULTS OF CATHODIC POLARIZATION OF STAINLESS STEEL CONDUCTOR ROLL SLEEVES IN PLATING SOLUTION

| pH | Temperature, C. | $E_{corr}$, mV** | $\beta_c$, mV/decade | $i_{corr}$, $\mu A/cm^2$* |
|---|---|---|---|---|
| 1.66 | 55 | +336 | 220 | 0.7 |
| 1.66 | 75 | +332 | 305 | 5.2 |

*Note:
100 $\mu A/cm^2$ is equivalent to a metal loss of 10.5 microinches/hour
**Note:
Reference: Saturated Calomel Electrode

TABLE 2

RESULTS OF CATHODIC POLARIZATION OF STAINLESS STEEL CONDUCTOR ROLL SLEEVES IN RINSING WATER

| pH | Temperature, C. | $E_{corr}$, mV** | $\beta_c$, mV/decade | $i_{corr}$, $\mu A/cm^2$* |
|---|---|---|---|---|
| 2.0 | 50 | −392 | 109 | 35 |
| 2.0 | 70 | −390 | 89 | 76 |
| 1.0 | 50 | −333 | 73 | 46 |
| 1.0 | 70 | −314 | 53 | 100 |

*Note:
100 $\mu A/cm^2$ is equivalent to a metal loss of 10.5 microinches/hour
**Note:
Reference: Saturated Calomel Electrode

EXAMPLE 2

A conductor roll rinse system was designed to be split into two systems. This was to allow for the possibility of zinc to be plated in the first fourteen cells, supplied by two work tanks, and zinc alloy to be plated in the last four cells, supplied by a third work tank. For this reason, the last five conductor rolls, Nos. 15 thru 19, were selected and isolated for testing the hydrogen peroxide. Small piping changes were used to complete the split, as well as the addition of a separate pH sensing uint to control acid additions to the "zinc alloy" conductor roll rinse storage tank.

The conductor rolls were measured every two weeks during the scheduled maintenance period. A Pi tape (a device that converts circumference measurements directly into diameter readings) was used to measure the rolls. The measurements were taken at 2", 20" and 40" from the north edge of each roll. The readings at the 20" and 40" position were subtracted from the 2" reading and used to compute the wear rate in mils of diameter loss per week. The reading at the 2" position was used as the baseline because it is outside the region of the strip contact and showed very little, if any, wear. Also, by using the 2" measurement, the effects of variations in roll temperature were minimized. The usual wear rate, without peroxide, had been 3–5 mils per week and the normal practice has been to remove the rolls and regrind them when the total wear reaches 30–35 mils. For the wear rate calculations, the maximum difference between the 2" reading and either the 20" or 40" measurement was used.

The laboratory studies indicated that hydrogen peroxide was effective in reducing corrosion at a concentration of at least 50 ppm but was most effective at 500 ppm or above. Therefore, the aim specification limits were set at 500 to 1000 ppm. Higher concentrations could be utilized but the effect was not enhanced and costs were increased. The concentration was controlled manually by increasing or decreasing the rate of the metering pump. The analysis of the rinsing solutoin was accomplished by titration of the peroxide with standard potassium permanganate ($KMnO_4$) solution and was performed three times per eight hour shift.

The daily $H_2O_2$ concentration for one month averaged 667 ppm and ranged from 368 to 1108 ppm. For the following month, the average was 788 ppm and ranged from 492 to 1125 ppm. Forty-three drums of hydrogen peroxide was consumed during the two months of testing, equivalent to an average consumption of one 500-lb. drum every 25.7 hours.

The diameter measurements for each roll and the calculated wear rates are shown in Table 3. The average overall wear rate was reduced by 50%, from 4.8 mils/week to 2.4 mils/week. All five rolls showed improvement ranging from 30% improvement on roll 16 to 78% improvement on roll 18.

FIGS. 6–10 are linear regression plots of the maximum diameter loss of the rolls in mils. vs. days of service for each roll, with an without hydrogen peroxide addition. The rolls at positions 15 and 16 were of standard construction. Peroxide additions were started after these rolls were already in service for 50 days.

TABLE 3

| | Diameter Measurements - Without $H_2O_2$ | | | | | | Diameter Measurements - With $H_2O_2$ | | | | | |
|---|---|---|---|---|---|---|---|---|---|---|---|---|
| Position | Days | 2" Inch | 20" Inch | 40" Inch | Max. Diff. Mils | Cumulative Wear Rate Mils/Week | Days | 2" Inch | 20" Inch | 40" Inch | Max. Diff. Mils | Cumulative Wear Rate (Mils/Week) |
| 15 | 0 | 40.130 | 40.130 | 40.130 | 0 | | 50 | 40.135 | 40.103 | 40.100 | 35 | 4.9 |
| | 07 | 40.133 | 40.130 | 40.129 | 04 | 4.0 | 86 | 40.134 | 40.124 | 40.105 | 29 | 3.2 |
| | 14 | 40.133 | 40.128 | 40.126 | 08 | 4.0 | 78 | 40.128 | 40.098 | 40.094 | 34 | 3.1 |
| | 19 | 40.133 | 40.131 | 40.116 | 18 | 8.7 | 92 | 40.132 | 40.093 | 40.090 | 42 | 3.2 |
| | 21 | 40.140 | 40.120 | 40.125 | 20 | 6.7 | 108 | 40.130 | 40.086 | 40.083 | 47 | 3.1 |
| | 38 | 40.140 | 40.123 | 40.113 | 27 | 5.3 | | | | | | |
| 16 | 0 | 39.995 | 39.995 | 39.995 | 0 | | 52 | 40.000 | 39.974 | 39.974 | 26 | 3.5 |
| | 09 | 40.000 | 39.992 | 39.993 | 08 | 6.2 | 67 | 40.002 | 39.970 | 39.988 | 34 | 3.8 |
| | 16 | 40.000 | 39.997 | 39.993 | 07 | 3.1 | 80 | 39.996 | 39.969 | 39.969 | 27 | 2.4 |
| | 21 | 39.995 | 39.982 | 39.982 | 13 | 4.3 | 94 | 39.997 | 39.960 | 39.957 | 40 | 3.0 |
| | 23 | 39.999 | 39.990 | 39.985 | 14 | 4.3 | 108 | 40.000 | 39.957 | 39.953 | 47 | 3.1 |

TABLE 3-continued

| | Diameter Measurements - Without $H_2O_2$ | | | | | | Diameter Measurements - With $H_2O_2$ | | | | | |
|---|---|---|---|---|---|---|---|---|---|---|---|---|
| Position | Days | 2" Inch | 20" Inch | 40" Inch | Max. Diff. Mils | Cumulative Wear Rate Mils/Week | Days | 2" Inch | 20" Inch | 40" Inch | Max. Diff. Mils | Cumulative Wear Rate (Mils/Week) |
| | 38 | 39.998 | 39.986 | 39.975 | 23 | 4.3 | | | | | | |
| 17 | 0 | 40.228 | 40.228 | 40.228 | 0 | | 0 | 40.179 | 40.179 | 40.179 | 0 | |
| | 14 | 40.230 | 40.218 | 40.220 | 12 | 6.0 | 15 | 40.182 | 40.179 | 40.188 | 03 | 1.4 |
| | 21 | 40.230 | 40.220 | 40.221 | 09 | 3.0 | 28 | 40.182 | 40.178 | 40.174 | 08 | 2.0 |
| | 23 | 40.228 | 40.214 | 40.218 | 14 | 3.6 | 42 | 40.188 | 40.177 | 40.170 | 18 | 3.0 |
| | 38 | 40.230 | 40.210 | 40.210 | 20 | 4.0 | | | | | | |
| 18 | 0 | 40.192 | 40.192 | 40.192 | 0 | | 0 | 40.148 | 40.148 | 40.148 | 0 | |
| | 06 | 40.200 | 40.193 | 40.196 | 07 | 8.2 | 15 | 40.148 | 40.150 | 40.154 | 0 | 0.0 |
| | 20 | 40.202 | 40.188 | 40.188 | 14 | 4.9 | 28 | 40.145 | 40.144 | 40.144 | 04 | 1.0 |
| | 27 | 40.200 | 40.183 | 40.184 | 17 | 4.4 | 42 | 40.148 | 40.145 | 40.138 | 12 | 2.0 |
| | 34 | 40.200 | 40.180 | 40.181 | 20 | 4.1 | 56 | 40.145 | 40.138 | 40.133 | 12 | 1.5 |
| | 41 | 40.202 | 40.180 | 40.179 | 23 | 3.9 | | | | | | |
| 19 | 0 | 40.233 | 40.233 | 40.233 | 0 | | 0 | 40.184 | 40.184 | 40.184 | 0 | |
| | 14 | 40.237 | 40.228 | 40.231 | 09 | 4.5 | 15 | 40.193 | 40.192 | 40.185 | 08 | 3.7 |
| | 21 | 40.242 | 40.223 | 40.222 | 20 | 6.7 | 28 | 40.191 | 40.195 | 40.184 | 07 | 1.8 |
| | 28 | 40.240 | 40.222 | 40.226 | 18 | 4.5 | 42 | 40.200 | 40.187 | 40.186 | 14 | 2.3 |
| | 35 | 40.239 | 40.218 | 40.217 | 23 | 4.6 | 56 | 40.193 | 40.181 | 40.179 | 14 | 1.8 |
| | Overall Average Wear Rate - | | | | | 4.8 | Overall Average Wear Rate - | | | | | 2.4 |

EXAMPLE 3

To simulate the production condition in which zinc is deposited on conductor rolls, a piece of zinc electrode was connected externally to stainless steel. As shown in Table 4, the corrosion potential of stainless steel changed from −360 mV to −760 mV upon connection to zinc. A galvanic current of 300 $\mu A/cm^2$ was measured. With additions of hydrogen peroxide up to 725 ppm, the corrosion potential of stainless steel still shifted from +200 mV (uncoupled) to a very active −720 mV when it is connected to the zinc electrode. The galvanic current also remains unchanged at 300 $\mu A/cm^2$ with the addition of peroxide.

In the pure sulfuric acid solution, stainless steel showed a typical active-passive anodic polarization behavior with high current densities in the active region (between −324 mV and about −50 mV) and low current densities in the passive region (between −50 mV and +800 mV). As 68 ppm hydrogen peroxide was added, the stainless steel passivates spontaneously; its corrosion potential shifting from −324 to +144 mV.

Figure 12:
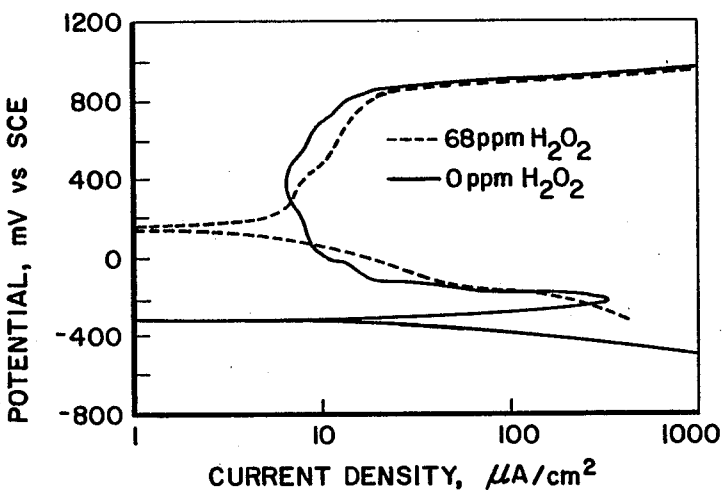
FIG. 12 shows the polarization curves of stainless steel in sulfuric acid solutions and without hydrogen peroxide.

FIG. 12 shows the polarization curves of stainless steel in sulfuric acid solutions with and without hydrogen peroxide.

TABLE 4

Galvanic Corrosion Between Stainless Steel And Zinc In The Sulfuric Acid Solution (pH = 1.1, Temperature = 70 C.)

| | Corrosion Potential, $E_{corr}$, mV vs SCE | | | | |
|---|---|---|---|---|---|
| | uncoupled | | coupled | | |
| $H_2O_2$ ppm | stainless steel | Zinc | stainless steel | Zinc | Galvanic Current $i_g$, $\mu A/cm^2$ |
| 0 | −360 | −1050 | −760 | −970 | 300 |
| 725 | +200 | −1050 | −720 | −980 | 300 |

EXAMPLE 4

The cahnge of corrosion potential of stainless steel after actrivation was monitored to determine the transition from active to passive state. The time required for the corrosion potential to shift from active to passive ranges was an indication of how fast the passive film formed. In these tests, the stainless steel sample was activated by applying a constant potential of −760 mV (which is the corrosion potential of stainless steel when coupled with zinc) for a certain period of time. After activation, the sample was allowed to corrode freely while its corrosion potential was recorded.

Figure 13A:
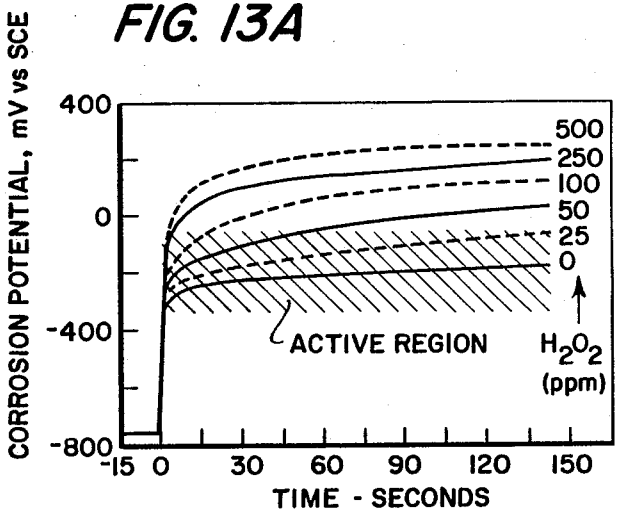
FIG. 13A and 13B show the corrosion potential changes of stainless steel after being activated at −760 mV for 15 seconds.
Figure 13B:
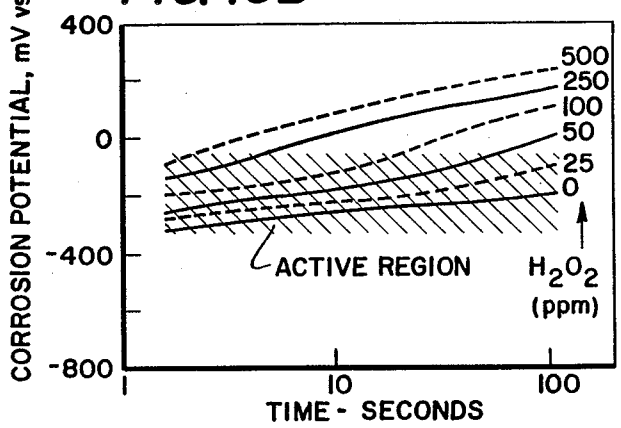

FIGS. 13A and 13B show the corrosion potential changes after 15 seconds activation at 45 C. The shaded area represents the potential range, −350 mV to −50 mV, where stainless steel is active. Without any hydrogen peroxide, the corrosion potential jumped to about −350 mV immediately after the applied potential was released, and gradually moved toward −150 mV after 140 seconds. The stainless steel remained active with high corrosion rates for more than 140 seconds after activation. With additions of hydrogen peroxide, the corrosion potentials shifted more rapidly toward the passive region. The time spent in the active region decreased from 140 seconds to 2.3 seconds as the concentration of hydrogen peroxide increased from 25 ppm to 500 ppm.

The corrosion rates determined after 200 hours are summarized in Table 5. In pure sulfuric acid, the corrosion rate of the uncoupled stainless steel was very low—0.003 $g/m^2/hr$. It increased 50 times to 0.155 $g/m^2/hr$ by cyclically coupling to zinc. The corrosion rate of zinc also slightly increased from 53.0 to 61.2 $g/m^2/hr$ by coupling to stainless steel. With the addition of 507 ppm hydrogen peroxide, the corrosion rate of the uncoupled stainless steel remained unchanged at 0.003 $g/m^2/hr$. However, it only increased to 0.025 $g/m^2/hr$ by couping to zinc. Thus, the corrosion resistance of stainless steel was improved by a factor of six (0.025 vs 0.155 $g/m^2/hr$) by the addition of 507 ppm hydrogen peroxide.

Figure 11:
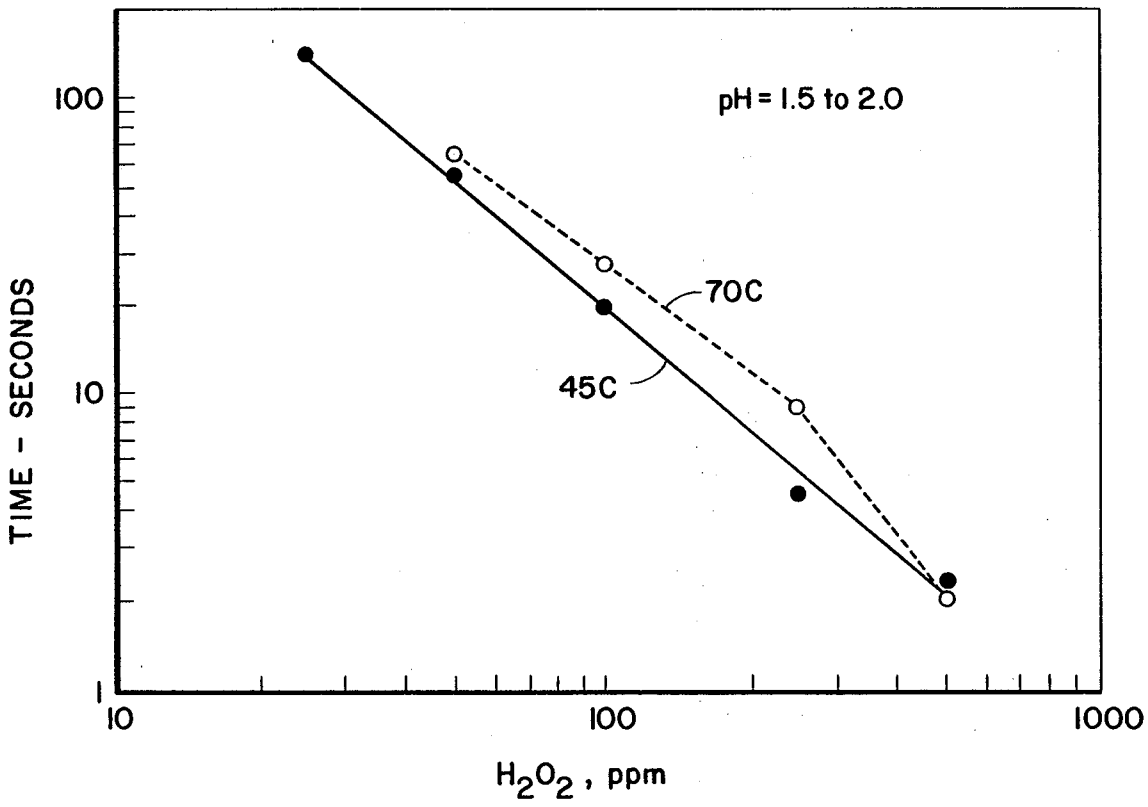
FIG. 11 shows the effect of hydrogen peroxide concentration on repassivation of stainless steel sleeves in the rinsing solution.

As seen in FIG. 11, the hydrogen peroxide also provides an effect on the repassivation of the stainless steel sleeve in the sulfuric acid rinse solution. The greater concentration of the hydrogen peroxide increased the acceleration of passive film formation during the active-passive transition cycle.

However, it was found that the peroxydisulfates could also passivate the stainless steel but were less effective in accelerating active-passive trasition when compared with hydrogen peroxide of an equivalent concentration.

TABLE 5

Corrosion Rates Of Stainless Steel And Zinc In Sulfuric Acid (pH = 1.5 to 2.0, Temperature = 45 C.)

| | Corrosion Rate*, $g/m^2/hr$ | | | |
|---|---|---|---|---|
| | Uncoupled | | Coupled (Cyclically**) | |
| $H_2O_2$, ppm | Stainless Steel | Zinc | Stainless Steel | Zinc |
| 0 | 0.003 | 53.0 | 0.155 | 61.2 |
| 507 | 0.003 | 63.0 | 0.025 | 58.8 |

*The corrosion rates were determined by the weight losses after 200 hours

**Stainless steel was connected externally to zinc for one second in every four seconds

What is claimed is:

1. In a process for electrodepositing a protective coating of zinc or a zinc alloy on iron or steel substrates in which said process utilizes a metal conductor roll or conductor roll with metal sleeves and contains a rinsing bath with a mineral acid solution associated with said roll, the improvement which comprises said mineral acid bath having at least 50 ppm of hydrogen peroxide or a peroxydisulfate compound.

2. The process of claim 1 wherein said mineral acid is sulfuric acid.

3. The process of claim 1 wherein said substrate is steel.

4. The process of claim 1 wherein said peroxydisulfate compound is an alkali or alkaline earth metal peroxydisulafte.

5. The process of claim 4 wherein said peroxydisulfate compound is selected from the group consisting of potassium peroxydisulfate and sodium peroxydisulfate.

6. The process of claim 1 wherein said peroxydisulfate compound is ammonium peroxydisulfate.

7. The process of claim 1 wherein hydrogen peroxide is present in said bath.

8. The proces of claim 7 wherein said bath comprises about 500 to 1000 ppm of hydrogen peroxide.

9. The process of claim 1 wherein the temperature of said rinse solution is less than 50° C.

10. The process of claim 1 wherein the pH of said rinse solution is at least 2.

11. The process of claim 1 wherein the zinc concentration of said rinse solution is maintained below 8 g/1.

12. The process of claim wherein said zinc alloy contain iron.

13. The process of claim 1 wherein said zinc alloy contains nickel.

14. In a process for electroplating a protective coating of zinc or a zinc alloy on a steel substrate wherein said process utilizes a conductor roll and a rinsing bath containing sulfuric acid solution associated with said roll, the improvement which comprises that said sulfuric acid solution contains about 500 to 1000 ppm of hydrogen peroxide and is maintained at a temperature below 50° C.

15. In a process for electroplating a protective coating of zinc or a zinc alloy on a steel substrate wherein said substrate passes over a conductor roll that has a tendency to corrode and which is associated with a rinsing bath comprising a dilute solution of sulfuric acid, the improvement which comprises maintaining said rinsing bath with a concentration of at least about 5 ppm of hydrogen peroxide or a peroxydisulfate compound, maintaining the temperature of said bath at less than about 50° C., maintaining the pH of said bath at not lower than 2 and continuously dissolving zinc deposits on said roll.

16. A method for preventing corrosion during depassivation-repassivation stages of a conductor roll or conductor roll sleeve which is partially immersed in a mineral acid rinsing solution during a process for electrodepositing a protective coating of zinc or a zinc alloy onto a steel substrate which comprises providing said rinsing solution with an oxidizing agent for causing the repassivation time to be less than the time of immersion in said rinsing solution.

17. The method of claim 16 wherein said oxidizing agent is selected from the group consisting of sodium peroxydisulfate, potassium peroxydisulfate, ammonium peroxydisulfate and hydrogen peroxide.

18. The method of claim 16 wherein said oxidizing agent is hydrogen peroxide and said hydrogen peroxide is present in said rinsing solution in an amount of at least 150 ppm.

19. The method of claim 18 wherein said hydrogen peroxide comprises about 500 to 1000 ppm.

* * * * *

UNITED STATES PATENT AND TRADEMARK OFFICE

CERTIFICATE OF CORRECTION

PATENT NO. : 4,840,712

DATED : June 20, 1989

INVENTOR(S) : Richard N. Steinbicker, Herbert E. Townsend, Yung-Herng Yau

It is certified that error appears in the above-identified patent and that said Letters Patent is hereby corrected as shown below:

Claim 15, line 7 after the word "about" delete the word "5" and insert therefor -- 50 --.

Claim 18, line 4, delete the word "150" and insert therefor -- 50 --.

Signed and Sealed this

Fourteenth Day of August, 1990

*Attest:*

HARRY F. MANBECK, JR.

*Attesting Officer*

*Commissioner of Patents and Trademarks*